US010092052B2

(12) United States Patent
Farnum et al.

(10) Patent No.: US 10,092,052 B2
(45) Date of Patent: Oct. 9, 2018

(54) COMPACT, ERGONOMIC, LIGHTED, RETRACTABLE SEAM RIPPER

(71) Applicant: DPG USA Inc, Schaumburg, IL (US)

(72) Inventors: Ronald C. Farnum, Lombard, IL (US); Sabrina Katz, Chicago, IL (US); Evan Ward, Chicago, IL (US); Daniel Schaumann, Chicago, IL (US)

(73) Assignee: DPG USA INC., Schaumburg, IL (US)

( * ) Notice: Subject to any disclaimer, the term of this patent is extended or adjusted under 35 U.S.C. 154(b) by 30 days.

(21) Appl. No.: 15/288,940

(22) Filed: Oct. 7, 2016

(65) Prior Publication Data

US 2017/0099903 A1 Apr. 13, 2017

Related U.S. Application Data

(60) Provisional application No. 62/239,110, filed on Oct. 8, 2015.

(51) Int. Cl.

| | |
|---|---|
| ***A41H 31/00*** | (2006.01) |
| ***F21V 33/00*** | (2006.01) |
| ***B26B 1/08*** | (2006.01) |
| *F21Y 115/10* | (2016.01) |
| *B26B 5/00* | (2006.01) |

(52) U.S. Cl.

CPC ..... *A41H 31/005* (2013.01); *B26B 1/08* (2013.01); *F21V 33/0084* (2013.01); *B26B 5/003* (2013.01); *F21Y 2115/10* (2016.08)

(58) Field of Classification Search

CPC . A41H 31/005; F21V 33/0084; B26B 11/008; B26B 1/08; B26B 5/003

USPC ..... 362/119–120; 30/162, DIG. 8

See application file for complete search history.

(56) References Cited

U.S. PATENT DOCUMENTS

| | | | | |
|---|---|---|---|---|
| 6,446,342 | B1 * | 9/2002 | Chang | B26B 1/08 30/123 |
| 2001/0033486 | A1 * | 10/2001 | Maine | B25B 9/00 362/119 |
| 2005/0167445 | A1 * | 8/2005 | Mochiachvili | B65D 47/06 222/113 |
| 2005/0283983 | A1 * | 12/2005 | Huang | B26B 5/001 30/162 |
| 2009/0038160 | A1 * | 2/2009 | Pomerantz | B26B 5/00 30/162 |

(Continued)

*Primary Examiner* — Anh Mai
*Assistant Examiner* — Michael Chiang
(74) *Attorney, Agent, or Firm* — Robert S. Alexander; Ferrells, PLLC; Anna L. Kinney

(57) ABSTRACT

A compact, ergonomic, lighted, retractable seam ripper is provided, having a housing, a retractable seam ripping blade, an LED, a battery, and a switch. The housing has generally planar exterior sidewalls and lower peripheral surface, a generally arcuate upper peripheral surface, a blade opening in the upper surface, and a longitudinally extending first and second rail generally parallel to the lower peripheral surface. The retractable seam ripping blade is mounted on a blade holder translatable along the first rail. A spring integral with the holder has a locking projection that engages locking depressions in the second rail. An actuating member between the spring and housing dislodges the locking projection from each of the locking depressions. The switch connects the LED to the battery when actuated.

6 Claims, 8 Drawing Sheets

(56) References Cited

U.S. PATENT DOCUMENTS

| | | | | |
|---|---|---|---|---|
| 2011/0083326 | A1* | 4/2011 | Sullivan | B26B 1/08 30/162 |
| 2016/0023364 | A1* | 1/2016 | Raymond | B26B 1/08 30/162 |

* cited by examiner

COMPACT, ERGONOMIC, LIGHTED, RETRACTABLE SEAM RIPPER

CLAIM FOR PRIORITY

This Non-Provisional patent application is based on U.S. Provisional Patent Application Ser. No. 62/239,110, filed on Oct. 8, 2015, the priority of which is claimed, and the disclosure of which is incorporated by reference.

BACKGROUND OF THE INVENTION

"To err is human" so it is safe to conjecture that seam rippers, in one form or another, have been around almost since the dawn of sewing. Traditionally, these take the form of a blade having a U-shaped cutting-edge recessed at the base of a larger U-shaped thread guide. In the typical case, the blade is fixed to an elongated rod shaped handle and a mating cover detachably mountable upon the handle covers the blade when not in use. Commonly, the detachable mating cover can also mount upon the rearmost end of the handle in the hope, often vain, that it will not be lost. In some cases, the handle is formed to be grasped in the palm with the blade being guided between the thumb and forefinger. Curiously, a commercially available embodiment of this design uses a curved blade rather than the more commonly encountered U-shaped. In other cases, less commonly, a method for shielding the blade in the handle is provided, either by retracting the blade into the handle or by rotating it into a slot formed in the handle. In still another case, a light is provided in the handle to facilitate accuracy.

However, what has heretofore been lacking in the retinue of tools available to the tailor or seamstress is a compact ergonomic lighted retractable seam ripper.

SUMMARY OF THE INVENTION

The present invention is drawn to a lighted retractable seam ripper. The seam ripper comprises a housing, a retractable seam ripping blade, and an LED with a switch and battery.

The housing has generally opposed exterior sidewalls, a generally planar lower peripheral surface joined to an upper peripheral surface, a longitudinally extending first guide within the housing, and a second longitudinally extending guide. The first guide is generally parallel to the generally planar lower peripheral surface. The second guide has two first locking portions formed therein. A blade opening is formed in the upper peripheral surface near an intersection of the upper peripheral surface and the generally planar lower peripheral surface. An illumination opening is formed in the generally arcuate upper peripheral surface spaced from, but closely adjacent to, the blade opening. The exterior sidewalls of the housing have elastomeric gripper pads located centrally thereupon.

The seam ripping blade has a tapered lower projection and a blunted upper projection with a U-shaped cutting-edge disposed therebetween. The seam ripping blade is mounted on a blade holder translatable along the first guide. A spring engages the blade holder and the second guide. The spring has a second locking portion biased against the second guide and mateable with either of the first locking portions. When one of the first locking portions is mated with the second locking portion, the seam ripping blade projects from the blade opening. When the second locking portion is mated with the other of the first locking portions, the seam ripping blade is retracted within the housing. An actuating member extends between the spring and the exterior of the housing. The actuating member, when urged inwardly, dislodges the locking portions from engagement. When the member is urged rearwardly or forwardly, the member impels the blade holder to translate along the first guide.

The LED is disposed adjacent to the illumination opening. A battery contained within the housing and a switch mounted in a wall of the housing operatively connect and disconnect the LED to the battery when actuated.

Other aspects and advantages of the present invention are described in the detailed description below and in the claims.

BRIEF DESCRIPTION OF THE DRAWINGS

The invention is described in detail below with reference to the appended drawings, wherein like numerals designate similar parts. In the Figures.

DETAILED DESCRIPTION OF THE PREFERRED EMBODIMENT

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

Figure 1:
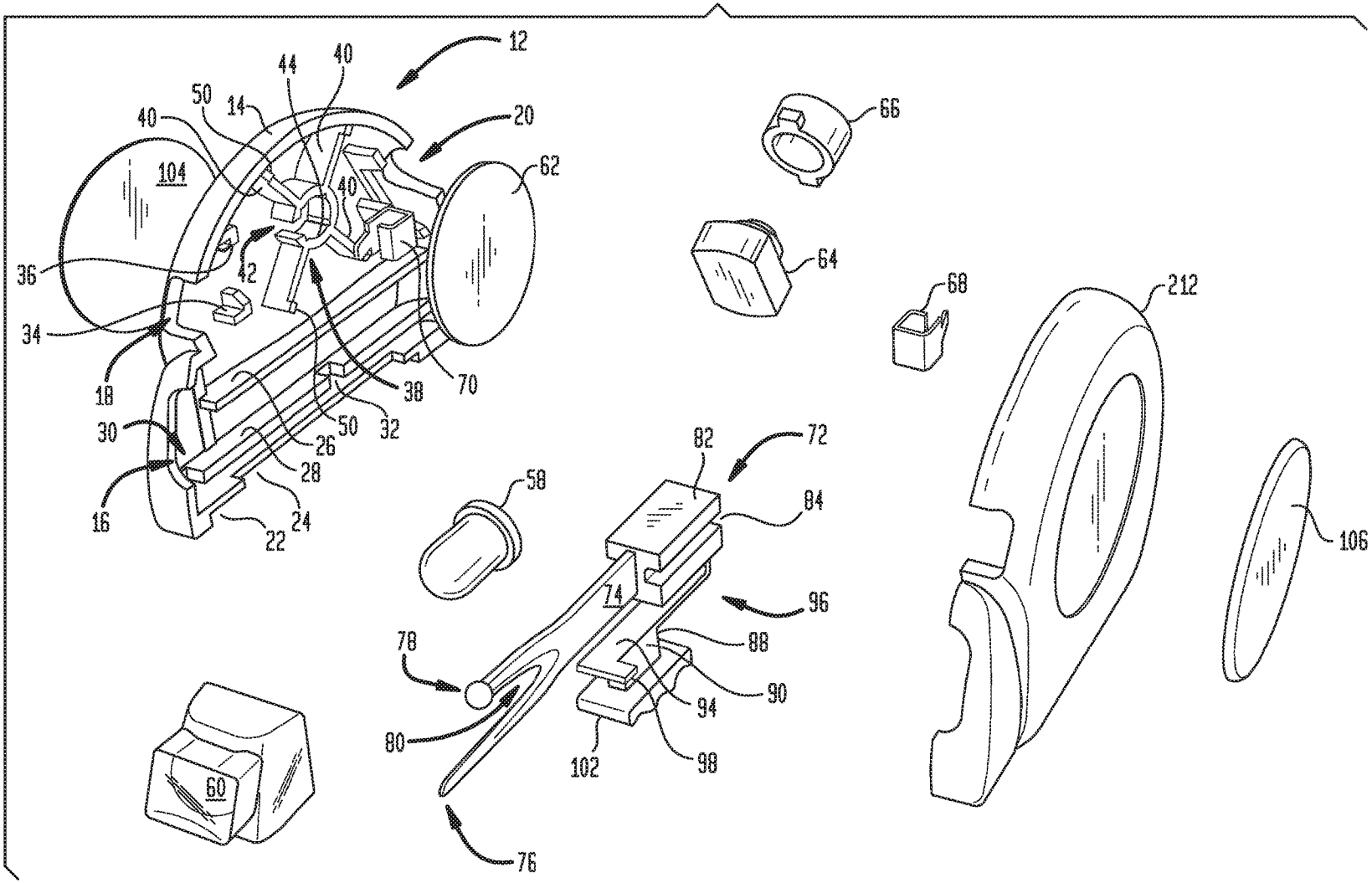
FIG. 1 is an exploded isometric view of the compact ergonomic lighted retractable seam ripper of the present invention.
Figure 2:
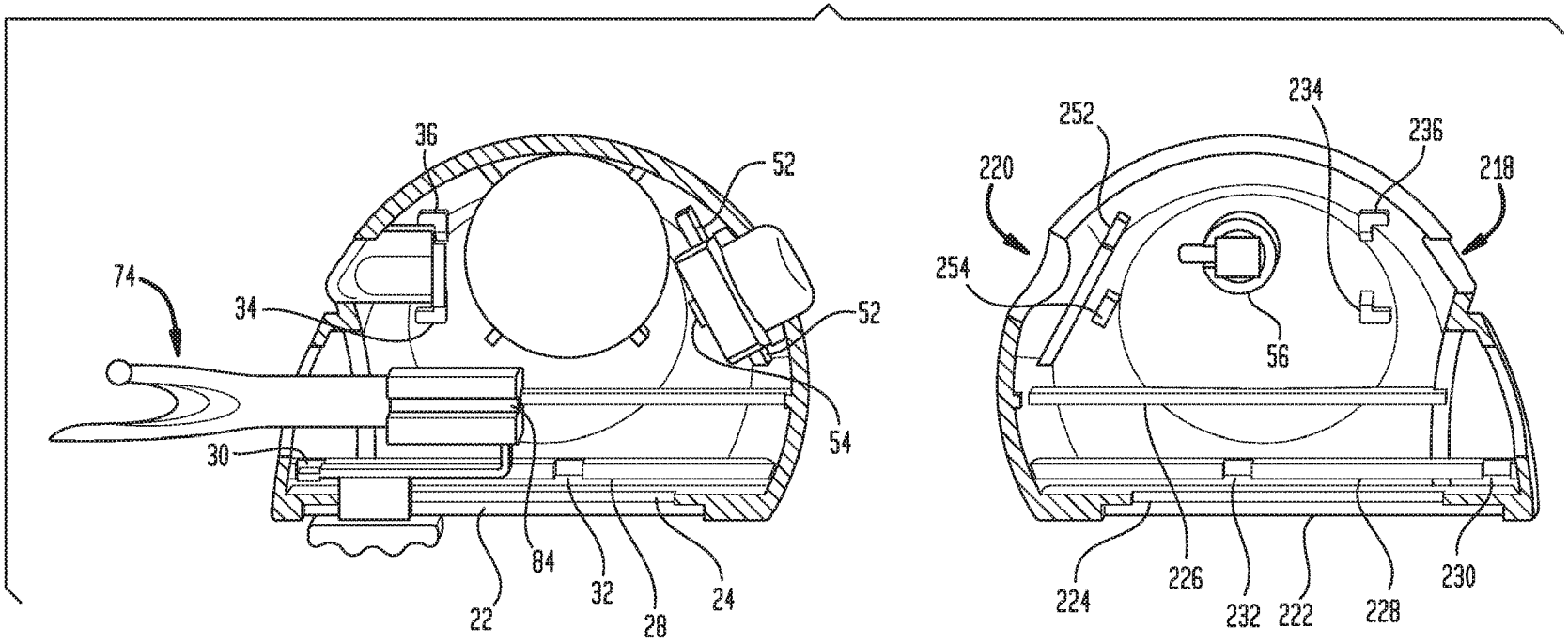
FIG. 2 is a sectional view of both halves of the compact ergonomic lighted retractable seam ripper of the present invention with the blade extended as in use.

In FIGS. 1 and 2, the compact ergonomic lighted retractable seam ripper 10 is comprised of unitary right-hand housing half 12 and unitary left-hand housing half 212 with unitary right-hand housing half 12 having upstanding peripheral wall 14 having formed therein: right blade retraction recess 16; right illumination recess 18; right illumination switch recess 20; and elongated inwardly displaced right positioning slot 22 with right positioning recess 24 being formed therein. Right upper positioning rail 26 extends rearwardly from a position adjacent right blade retraction recess 16. Right lower positioning rail 28 is spaced from and generally parallel to right upper positioning rail 26. Forward blade stop recess 30 and rearward blade stop recess 32 are formed in right lower positioning rail 28. Generally adjacent to and spaced above right blade retraction recess 16 is right illumination recess 18 formed in upstanding peripheral wall 14. Lower and upper right lamp retention angle lugs, 34, 36 are located inwardly and rearwardly adjacent right illumination recess 18. Battery support 38 comprising battery support ridges 40 extending radially from negative battery contact retention surround 42 having negative battery contact retention aperture 44 formed therein. Outermost ends of battery support ridges 40 have battery location lugs 50 formed thereupon. Right illumination switch recess 20 is formed in upstanding peripheral wall 14 rearwardly of battery support 38 with recessed right switch retention ridge 52 disposed inwardly adjacent thereto with right retention lug 54 being spaced inwardly and closely adjacent therefrom.

In FIG. 2, it can be appreciated that many of the structures in left-hand housing half 212 are mirror images of the corresponding structures in right-hand housing half 12 and are numbered similarly but increased by 200 to distinguish them from structures in right-hand housing half 12. However, structure corresponding to battery support 38 is unnecessary in left-hand housing half 212 while positive battery contact retention surround 56 is formed between left illumination recess 218 and left illumination switch recess 220.

Figure 5:
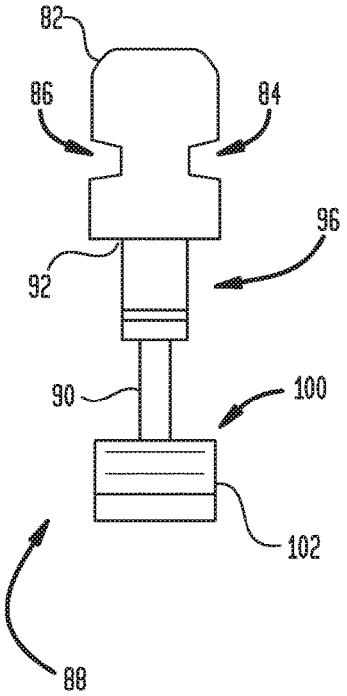
FIGS. 5, 6, and 7 illustrate the structure of a locking spring which is particularly advantageous in construction of the compact ergonomic lighted retractable seam ripper of the present invention.
Figure 6:
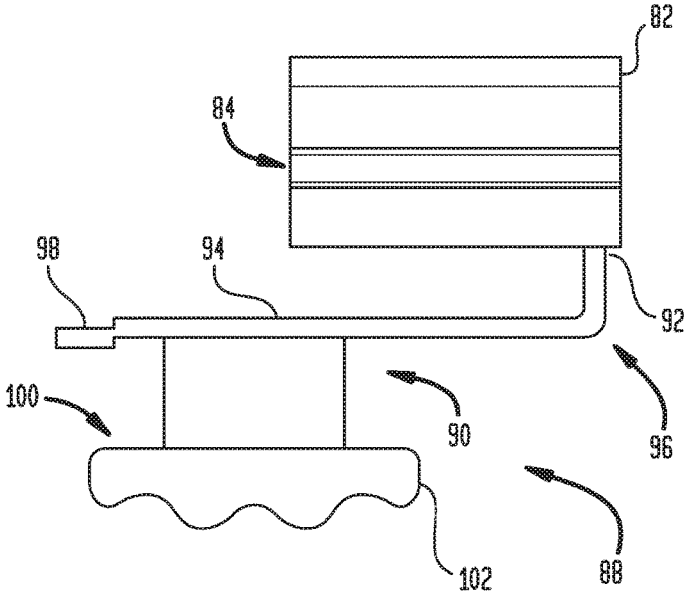
Figure 7:
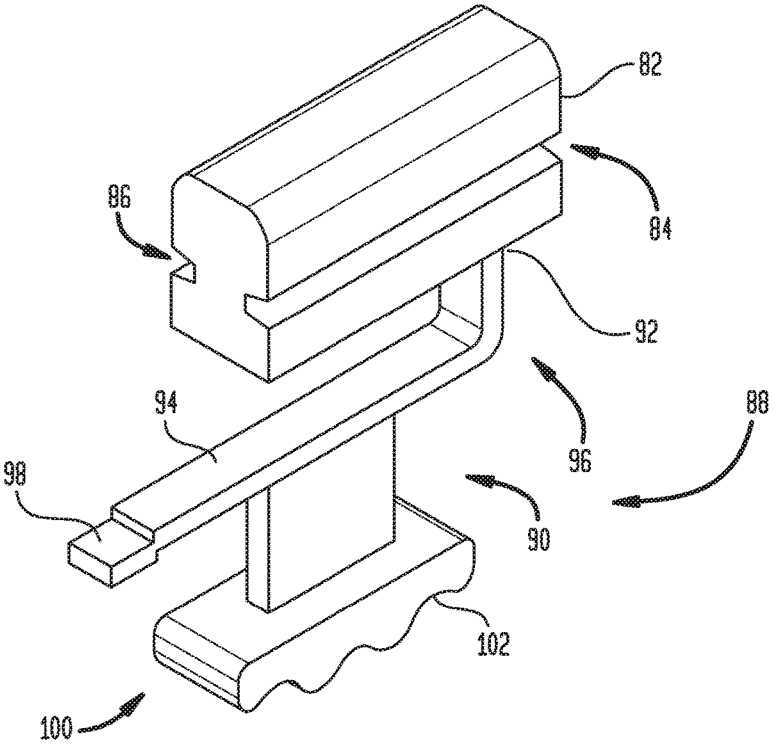

Returning to FIG. 1, lamp 58, transparent lamp cover 60, battery 62, illumination switch 64, illumination switch cover 66, positive battery contact 68, negative battery contact 70 and retractable blade assembly 72 are displayed in disposition congruent to their relative positions in the assembled compact ergonomic lighted retractable seam ripper 10 as seen in FIG. 2. Retractable blade assembly 72 comprises seam ripping blade 74 having tapered lower projection 76 and balled upper projection 78 with U-shaped cutting-edge 80 disposed therebetween. Seam ripping blade 74 is carried upon blade holder/guide 82 having left and right slots 84, 86 respectively adapted to engage right and left upper positioning rails 26, 226 and translate thereupon. As best shown in FIGS. 5, 6 and 7, locking spring 88, preferably formed integrally with bladeholder/guide 82 desirably comprises a vertically extending riser portion 90, the upper end 92 of which is joined to horizontally and longitudinally extending spring arm portion 94 having an upwardly extending support stanchion 96 integrally attached to a rearward portion of horizontally and longitudinally extending spring arm portion 94, a downwardly extending positioning projection 98 attached to a forward portion of said horizontally and longitudinally extending spring arm portion 94. Lower end 100 of vertically extending riser portion 90 extends exteriorly to compact ergonomic lighted retractable seam ripper 10 and is secured, preferably integrally, to positioning tab 102. Support stanchion 96 of locking spring 88 is fixed, preferably integrally, to blade holder/guide 82, while locking projection 98 is adapted to project through blade stop recesses 30, 32 in lower positioning rails 28, 228 with locking spring riser 90 riding between lower positioning rails 28, 228 extending longitudinally in compact ergonomic lighted retractable seam ripper 10 with positioning tab 102 being attached to locking spring riser 90 and residing in right and left elongated inwardly displaced positioning slot recesses 22, 222 formed by the left and right positioning recesses 24, 224. Horizontally and longitudinally extending spring arm portion 94 bears against lower positioning rails 28, 228 while locking projection 98 also riding upon lower positioning rails 28, 228 between forward and rearward blade stop recesses 30, 32. Downwardly extending positioning projection 98 formed in horizontally and longitudinally extending locking spring portion 94 is urged downwardly against lower positioning rails 28, 228 by spring action, and is adapted to be lodged within either forward or rearward blade stop recesses 30, 32 remaining fixed therein until dislodged by upward pressure against positioning tab 102, whereupon retractable blade assembly 72 is free to translate upon upper positioning rails 26, 226 until positioning projection 98 engages either of blade stop recesses 30, 32. Transparent lamp cover 60 having lamp 58 disposed therein is lodged between right and left illumination recesses 18, 218 and right and left lamp retention angle lugs 34, 36, 234, 236. Illumination switch 64 inside illumination switch cover 66 is positioned between right and left recessed switch retention ridges 52, 252 and bears against switch retention lugs 54, 254. Positive and negative battery contacts 68, 70 are lodged within negative and positive battery contact retention apertures 44, 56 while wiring (not shown) operatively connects both battery 62, contacts 70, 68 with lamp 58 and illumination switch 64 so that lamp 58 can be illuminated by manipulation of illumination switch 64. Optionally, right and left thermoplastic elastomer pads 104, 106 may be exteriorly attached to housing sidewalls 12, 212 to ease gripping thereof. Housing sidewalls 12, 212 may be formed from polypropylene or any other convenient polymer by injection molding and joined to each other by ultrasonic welding.

Figure 3:
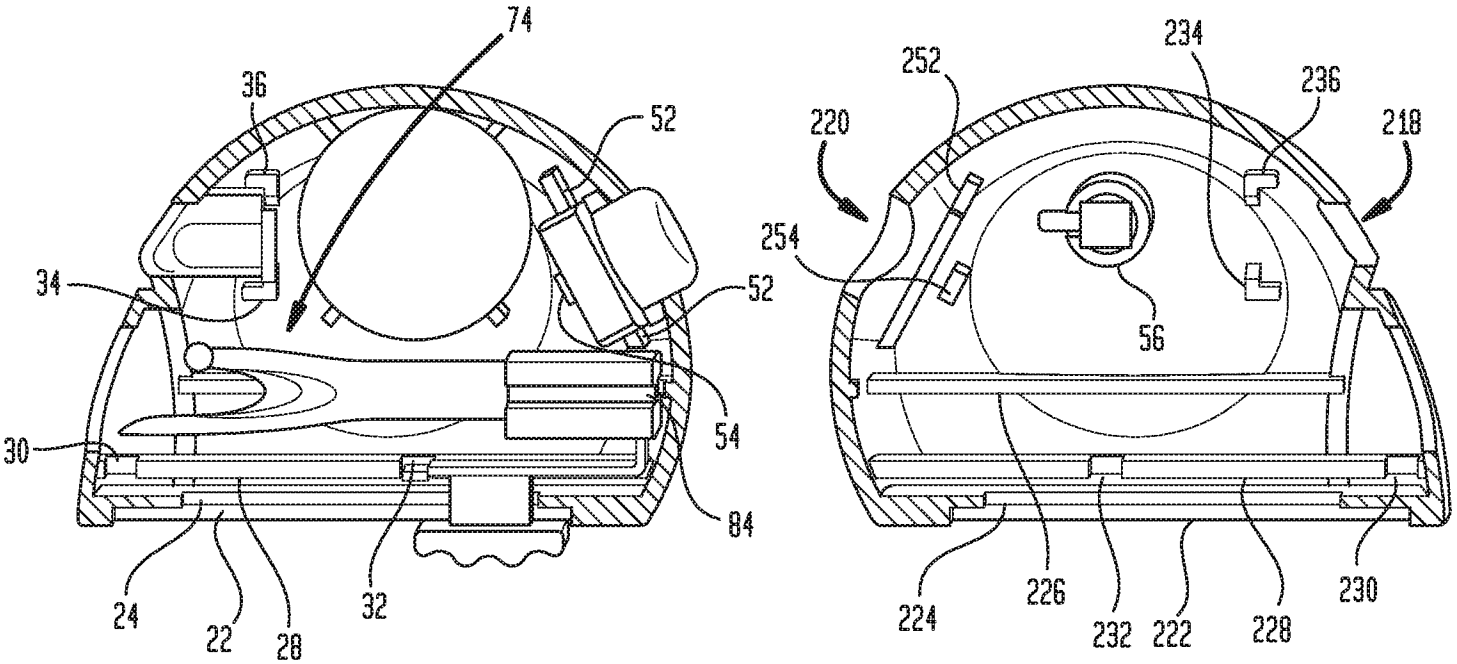
FIG. 3 is a sectional view of both halves of the compact ergonomic lighted retractable seam ripper of the present invention with the blade retracted as in storage.
Figure 4:
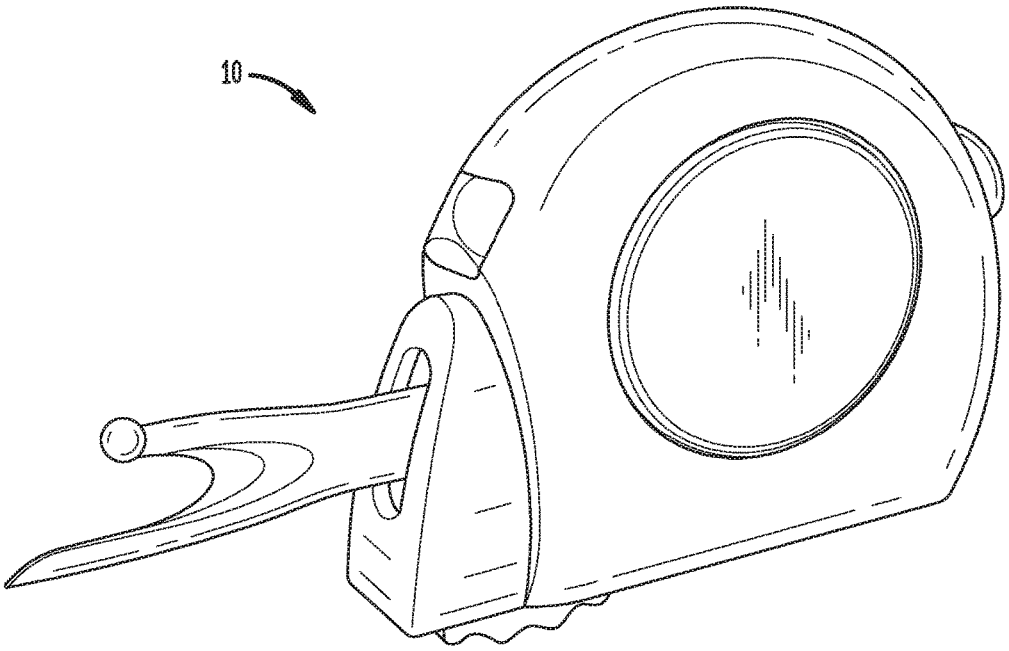
FIG. 4 is an isometric perspective of the compact ergonomic lighted retractable seam ripper of the present invention with the blade extended.

FIG. 2 illustrates compact ergonomic lighted retractable seam ripper 10 with seam ripping blade 74 projecting therefrom, while FIG. 3 illustrates the retracted conformation. Desirably, compact ergonomic lighted retractable seam ripper 10 has a thickness of between about 0.25 inches and 0.85 inches, an overall length of between 1¼ inches and 4 inches with the blade retracted so that it may be easily grasped between the thumb and forefinger of either hand. Desirably, the upper periphery of the housing is generally arcuate having a smooth profile with a radius of curvature of between 0.75 inches and 2.25 inches while the lower periphery is generally planar. More preferably at least a portion of the generally arcuate surface is generally in the form of the outer surface of a partial annulus or more precisely, a partial torus.

Figure 8:
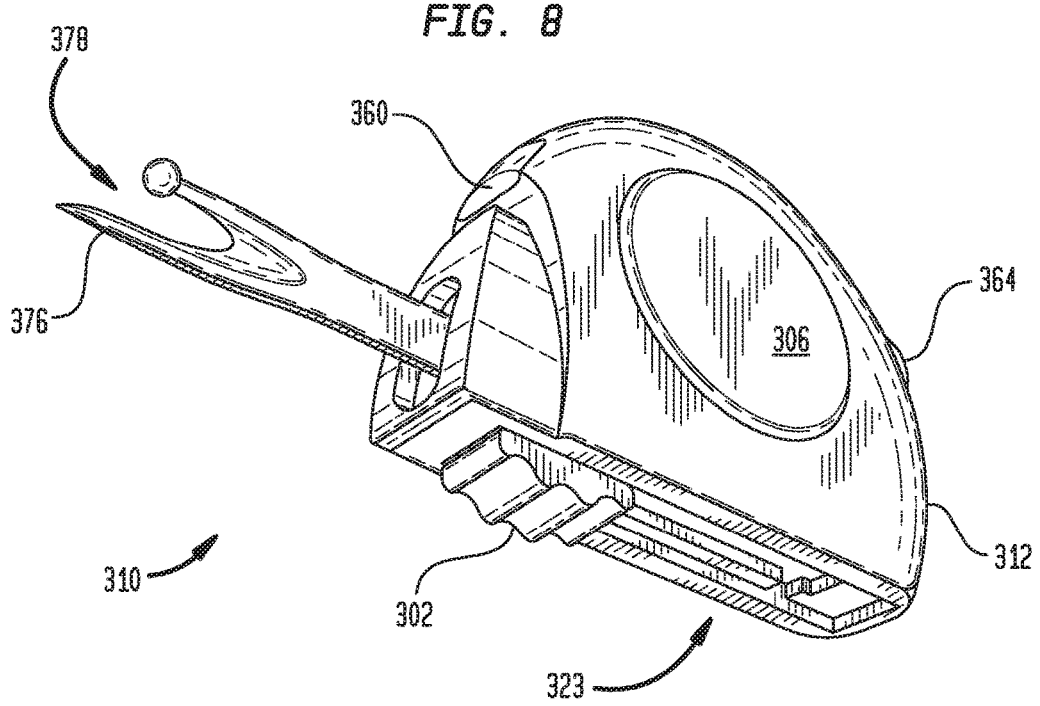
FIG. 8 is an isometric perspective illustrating a preferred embodiment compact ergonomic lighted retractable seam ripper of the present invention in which the seam ripping blade is lowered relative to the lowest extremity of the housing.
Figure 9:
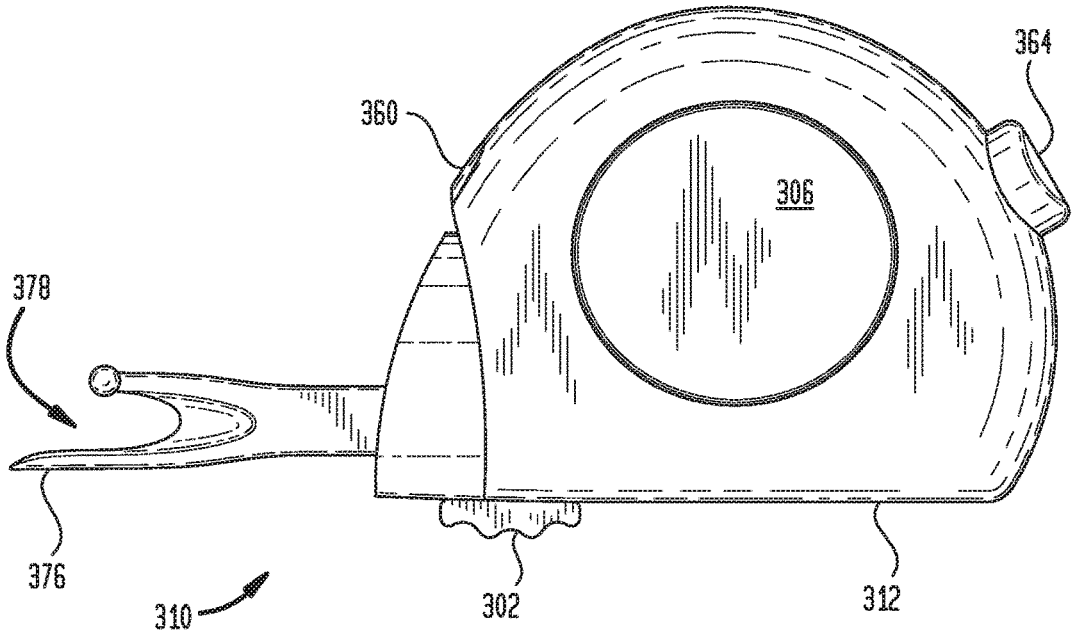
FIG. 9 is a left elevation of the compact ergonomic lighted retractable seam ripper of FIG. 8.

FIGS. 8 and 9 illustrate the outer appearance of a compact ergonomic lighted retractable seam ripper 310 in seam ripping blade 378 is disposed so that tapered lower projection 376 is no more than ⅜ of an inch, preferably no more than 5/16 and most preferably no more than ¼ inch, above the lower surface of housing 312. Decreasing the clearance between tapered lower projection 376 and the lower surface of housing 312 greatly increases the ease with which compact ergonomic lighted retractable seam ripper 310 may be used. In FIGS. 8 and 9 seam ripping blade 378 is retracted and advanced by manipulation of positioning tab 302 riding in positioning trench 323. Lamp 358 (see FIGS. 10 and 11) behind transparent lamp cover 360 is functionally identical to the lamp described in previous embodiments as is illumination switch 364 and battery 362. Thermoplastic elastomer pads 304 (not visible) and 306 are provided as before to facilitate easy gripping.

Figure 10:
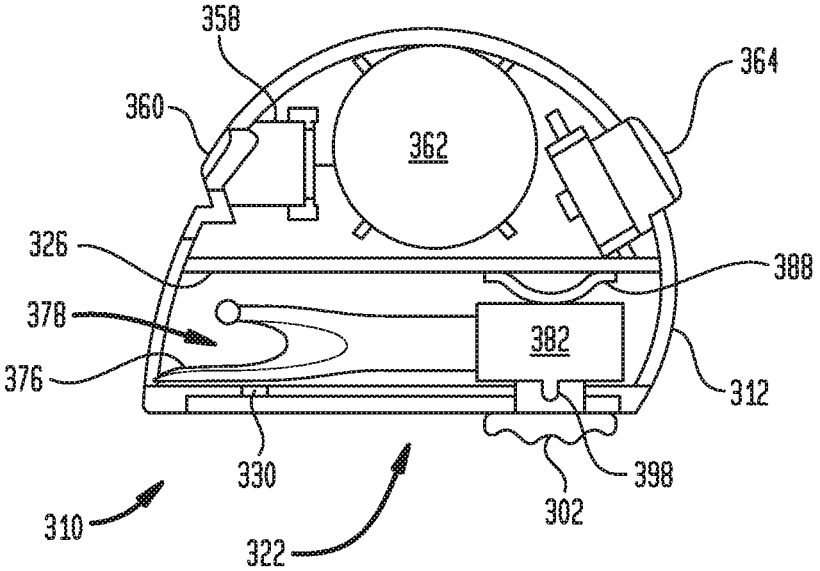
FIGS. 10 and 11 are sectional views illustrating the interior workings of the preferred embodiment of FIGS. 8 and 9 in which the seam ripping blade is lowered.
Figure 11:
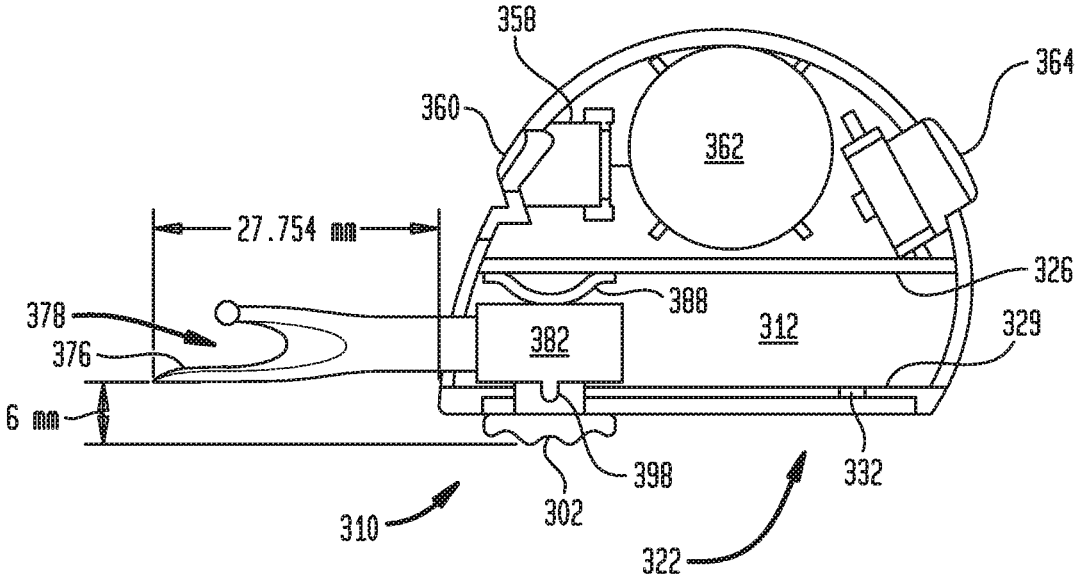

FIGS. 10 and 11 are sectional views illustrating the inner workings of compact ergonomic lighted retractable seam ripper 310 in which upper guide rail 326 extends substantially the length of housing 312 bearing against spring 388 integrally formed with blade holder 382, lower surface of which bears against generally planar bottom 329 of housing 312 having positioning slot 322 formed therein through which positioning tab 302 protrudes riding in positioning trench 323 in the lower surface of housing 312 (see FIG. 8.) Locking projection 398 formed on the lower surface of positioning block 382 and projecting laterally outward from positioning tab 302 can be selectively engaged with either rear positioning detent 332 or forward positioning detent 330. When as in FIG. 10, locking projection 398 engages rearward recess 332, blade 378 is retained within housing 312. Inward and forward pressure on positioning tab 302 dislodges locking projection 398 from rearward locking detent 332 allowing blade holder 382 to traverse positioning slot 322, whereupon locking projection 398 engages forward positioning detent 330 yielding a configuration shown in FIG. 11 in which blade 378 projects 27.754 mm from housing 312 being spaced only 6 mm above the lowermost point on positioning tab 302. Desirably spring 388, blade support block 382, including locking projection 398, and positioning tab 302 are integrally formed from a single piece of DELRIN®, also known as acetal or poly(oxymethylene) glycol, by injection molding yielding a strong, tough, lubricious piece which easily slides back and forth in positioning slot 322 in housing 312.

Figure 12:
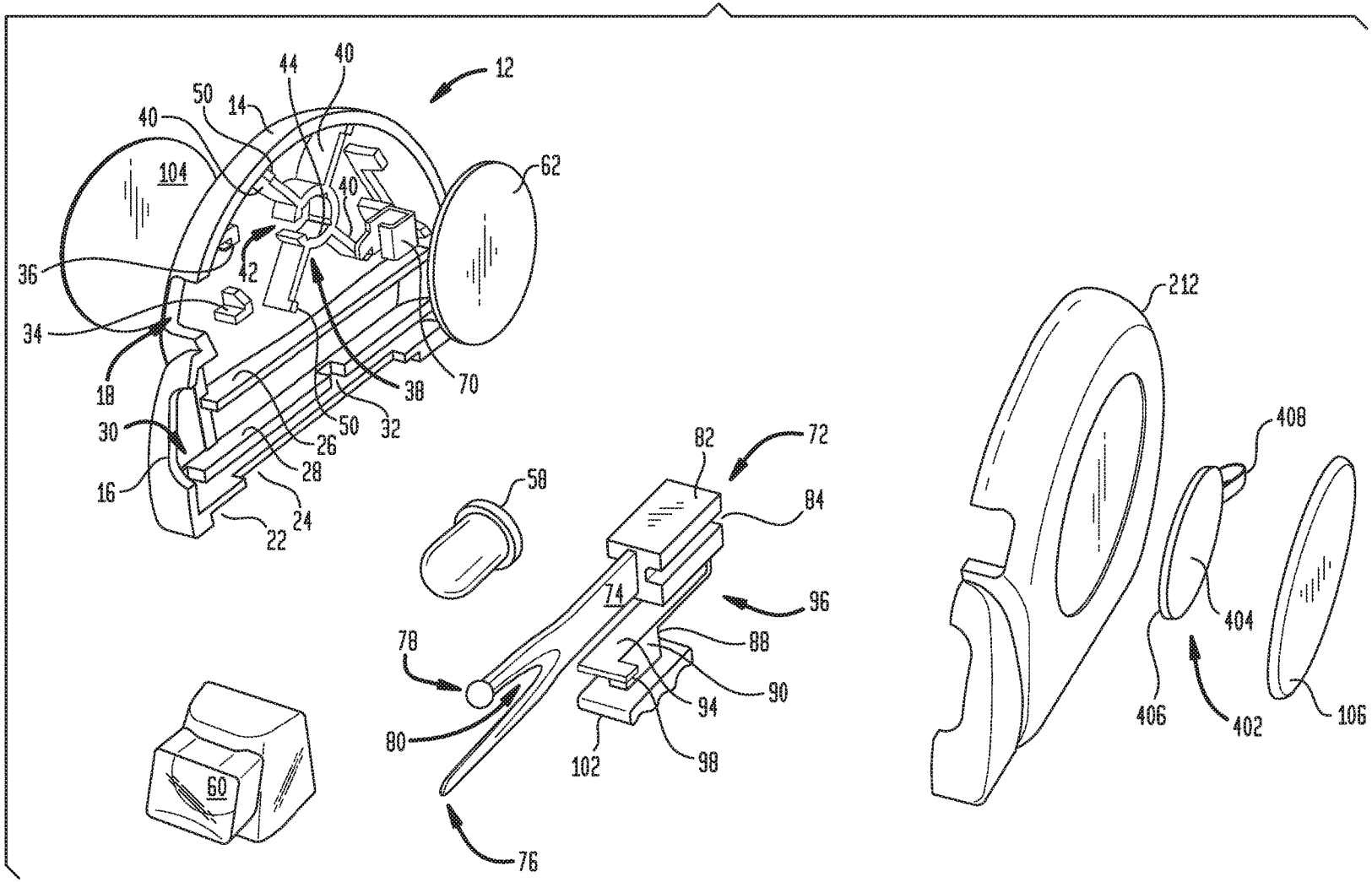
FIG. 12 is an exploded isometric of the seam ripper of the present invention in which a normally off switch is used to control the lamp to prevent premature exhaustion of the battery.

FIG. 12 illustrates another embodiment of the invention in which normally off contact switch 402, consisting of conductive contact plates 404 and 406 held apart by spring 408, is interposed between left-hand housing half 212 and left-hand thermoplastic elastomer pad 106 so that lamp 58 is only illuminated when compact ergonomic lighted retractable seam ripper 10 is grasped in use to preclude pre-mature exhaustion of battery 62.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

As our invention, we claim:

1. A compact ergonomic lighted retractable seam ripper having:

a housing having generally planar exterior sidewalls, each sidewall having an elastomeric grip pad centrally located thereupon, a generally planar lower peripheral surface joined to a generally arcuate upper peripheral surface, at least a portion of which is generally in the form of the outer surface of a partial annulus, a blade opening formed in the generally arcuate upper peripheral surface near an intersection of the generally arcuate upper peripheral surface and the generally planar lower peripheral surface, a longitudinally extending first rail within said housing generally parallel to the generally planar lower peripheral surface;

a retractable seam ripping blade mounted on a blade holder translatable along said first rail;

a second longitudinally extending rail having two locking depressions formed therein;

a spring integrally formed with said blade holder engaging said second rail, said spring having a locking projection biased against said second rail and mateable with either of said locking depressions, the seam ripping blade projecting from said blade opening when said locking projection is mated with one of said locking depressions and retracted within said housing when said locking projection is mated with the other of said locking depressions;

an actuating member extending between said spring and the exterior of said housing, said member being adapted to, when urged inwardly, dislodge said locking projection from each of said locking depressions when engaged therewith as well as to impel said blade holder to translate along said first rail when urged rearwardly or forwardly;

said seam ripping blade having a tapered lower projection and a blunted upper projection with a U-shaped cutting-edge disposed therebetween;

an illumination opening formed in said generally arcuate upper peripheral surface spaced from but closely adjacent to said blade opening, said illumination opening having an LED disposed adjacent thereto, a battery contained within said housing and a switch disposed to operatively connect and disconnect said LED to said battery when actuated.

2. The compact ergonomic lighted retractable seam ripper of claim 1, wherein said switch is a normally off pressure activated switch mounted between one of said sidewalls of said housing and said grip pad and configured such that said LED is illuminated when said grip pad is grasped.

3. A lighted retractable seam ripper having:

a housing with generally opposed exterior sidewalls, each sidewall having an elastomeric grip pad centrally located thereupon, a generally planar lower peripheral surface joined to a generally arcuate upper peripheral surface, at least a portion of which is generally in the form of the outer surface of a partial torus, a blade opening formed in the generally arcuate upper peripheral surface near an intersection of the generally arcuate upper peripheral surface and the generally planar lower peripheral surface, a longitudinally extending first guide within said housing generally parallel to the generally planar lower peripheral surface;

a retractable seam ripping blade mounted on a blade holder translatable along said first guide;

a second longitudinally extending guide having two first locking portions formed therein;

a spring engaging said blade holder and said second guide, said spring having a second locking portion biased against said second guide and mateable with either of said first locking portions, the seam ripping blade projecting from said blade opening when one of said first locking portions are mated with said second locking portion and retracted within said housing when said second locking portion is mated with the other of said first locking portions;

an actuating member extending between said spring and the exterior of said housing, said member being adapted to, when urged inwardly, dislodge said locking portions from engagement as well as to impel said blade holder to translate along said first guide when urged rearwardly or forwardly;

said seam ripping blade having a tapered lower projection and a blunted upper projection with a U-shaped cutting-edge disposed therebetween;

an illumination opening formed in said generally arcuate upper peripheral surface spaced from but closely adjacent to said blade opening, said illumination opening having an LED disposed adjacent thereto, a battery contained within said housing and a switch disposed to operatively connect and disconnect said LED to said battery when actuated.

4. The lighted retractable seam ripper of claim 3, wherein said switch is a normally off pressure activated switch mounted between one of said sidewalls of said housing and said grip pad and configured such that said LED is illuminated when said grip pad is grasped.

5. A lighted retractable seam ripper having:

a housing with generally opposed exterior sidewalls, each sidewall having an elastomeric grip pad centrally located thereupon, a generally planar lower peripheral surface joined to an upper peripheral surface, a blade opening formed in the upper peripheral surface near an intersection of the upper peripheral surface and the generally planar lower peripheral surface, a longitudinally extending first guide within said housing generally parallel to the generally planar lower peripheral surface;

a retractable seam ripping blade mounted on a blade holder translatable along said first guide;

a second longitudinally extending guide having two first locking portions formed therein;

a spring engaging said blade holder and said second guide, said spring having a second locking portion biased against said second guide and mateable with either of said first locking portions, the seam ripping blade projecting from said blade opening when one of said first locking portions are mated with said second locking portion and retracted within said housing when said second locking portion is mated with the other of said first locking portions;

an actuating member extending between said spring and the exterior of said housing, said member being adapted to, when urged inwardly, dislodge said locking portions from engagement as well as to impel said blade holder to translate along said first guide when urged rearwardly or forwardly;

said seam ripping blade having a tapered lower projection and a blunted upper projection with a U-shaped cutting-edge disposed therebetween;

an illumination opening formed in said upper peripheral surface spaced from but closely adjacent to said blade opening, said illumination opening having an LED disposed adjacent thereto, a battery contained within said housing and a switch disposed to operatively connect and disconnect said LED to said battery when actuated.

6. The lighted retractable seam ripper of claim 5, wherein said switch is a normally off pressure activated switch mounted between one of said sidewalls of said housing and said grip pad and configured such that said LED is illuminated when said grip pad is grasped.

* * * * *